United States Patent [19]

Demarest, Jr.

[11] Patent Number: 4,819,812

[45] Date of Patent: Apr. 11, 1989

[54] SELF-CONTAINED PORTABLE HANGING CLOTHES DRYER

[76] Inventor: Russell G. Demarest, Jr., 60 Forest Rd., Glen Rock, N.J. 07452

[21] Appl. No.: 215,343

[22] Filed: Jul. 5, 1988

[51] Int. Cl.[4] ..... A47B 53/00

[52] U.S. Cl. ..... 211/1.3; 211/123

[58] Field of Search ..... 211/1.3, 105.3, 105.1, 211/105.4–105.6, 113, 119, 123

[56] References Cited

U.S. PATENT DOCUMENTS

| | | | |
|---|---|---|---|
| 1,276,300 | 8/1918 | Wideen | 211/172 |
| 1,587,676 | 6/1926 | Patterson | 211/1.3 |
| 1,729,395 | 9/1929 | Mandel | 211/172 |
| 3,471,031 | 10/1969 | Coplan | 211/100 X |
| 3,784,020 | 1/1974 | Steiner | 211/1.3 |
| 4,103,781 | 8/1978 | Sterling | 211/123 X |
| 4,361,914 | 12/1982 | Oliver | 211/123 X |

FOREIGN PATENT DOCUMENTS

| | | | |
|---|---|---|---|
| 728547 | 2/1966 | Canada | 211/1.3 |

*Primary Examiner*—Alvin C. Chin-Shue
*Assistant Examiner*—Sarah A. Lechok Eley
*Attorney, Agent, or Firm*—Samuelson & Jacob

[57] ABSTRACT

A self-contained, portable dryer for use in drying articles of clothing includes a hanger bar with telescoping segments for selective collapse and extension, and a plurality of hangers stored within the telescoping segments and retrievable from within the hanger bar for erection and suspension from the hanger bar in one of two selectable configurations to accommodate the various articles of clothing ordinarily washed or rinsed out by travelers and hung out to dry at facilities available to such travelers.

13 Claims, 3 Drawing Sheets

SELF-CONTAINED PORTABLE HANGING CLOTHES DRYER

The present invention relates generally to personal convenience devices and pertains, more specifically, to a self-contained portable device primarily for use by travelers, enabling ease of carrying and simplicity of use in drying articles of clothing by hanging the clothing at a location usually available while traveling.

A wide variety of convenience devices have been offered to travelers over the years. Among such devices are those designed to enable a traveler to wash and then dry certain articles of clothing in a convenient manner, utilizing the facilities usually available while traveling. Various clothes lines and drying racks have been created in highly compact and portable forms for enabling a traveler to carry a clothes drying device with ease and to erect and use the device in a simple manner. The present invention is an improvement in a compact self-contained portable dryer for use in the hanging of articles of clothing for drying at locations ordinarily encountered by travelers, utilizing facilities which usually are available at such locations, and presents several objects and advantages, some of which may be summarized as follows: Highly compact and very lightweight for exceptional portability; Provides a complete and highly versatile drying apparatus for accommodating all of the various articles of clothing ordinarily washed by a traveler, such as shirts and blouses, socks and stockings, undergarments and the like, utilizing commonly available travel facilities, such as hotel and motel rooms; Simple construction for unobtrusive carrying when not in use and for ease of erection and installation when placed into use; Rugged construction for withstanding the rigors of packing and carrying, as well as for bearing the load of hanging wet articles of clothing during use; Economy of manufacture and sale for widespread acceptability.

The above objects and advantages, as well as further objects and advantages is accomplished by the present invention, which may be described briefly as a self-contained, portable dryer for use in drying articles of clothing by supporting the dryer between existing opposed structural members spaced apart by a given lateral distance, such as a shower curtain rail and an opposite shower wall, and hanging the articles of clothing from the dryer, the dryer comprising: a hanger bar extending between opposite ends and including a first segment and a second segment, the first segment having a sleeve-like configuration for receiving the second segment in telescoping engagement therewith, and each segment including a wall extending along the length of the respective segment; selective securement means on the hanger bar for selectively securing the first and second segments against relative telescoping movement when the first and second segments are at either one of a collapsed position, wherein the second segment is substantially entirely telescoped within the first segment for compact carrying, and an extended position, wherein the second segment is essentially tandem with the first segment and the length of the hanger bar between the ends thereof exceeds at least slightly the lateral distance between the opposed existing structural members for supporting the hanger bar between the structural members; a plurality of suspension elements integral with the wall of at least one of the first and second segments; a plurality of hangers, each hanger having laterally-extending hanger members and a bail associated with the hanger members; collapsing means coupling each bail with corresponding hanger members such that the bail is selectively movable between a first position wherein the bail is extended to project altitudinally relative to the laterally-extending hanger members, and a second position wherein the bail is collapsed to extend laterally in coextensive relationship with the hanger members; each bail including connector means for selective engagement with a suspension element when the bail is in the extended position for suspending the corresponding hanger from the hanger bar, with each bail oriented altitudinally and the hanger members oriented laterally for the reception of the articles to be hung for drying; and a chamber within the hanger bar for reception of the hangers, when the respective bails are in the collapsed position, for storage of the hangers when not in use.

The invention will be understood more fully, while still further objects and advantages will become apparent, in the following detailed description of a preferred embodiment of the invention illustrated in the accompanying drawing, in which.

Figure 1:
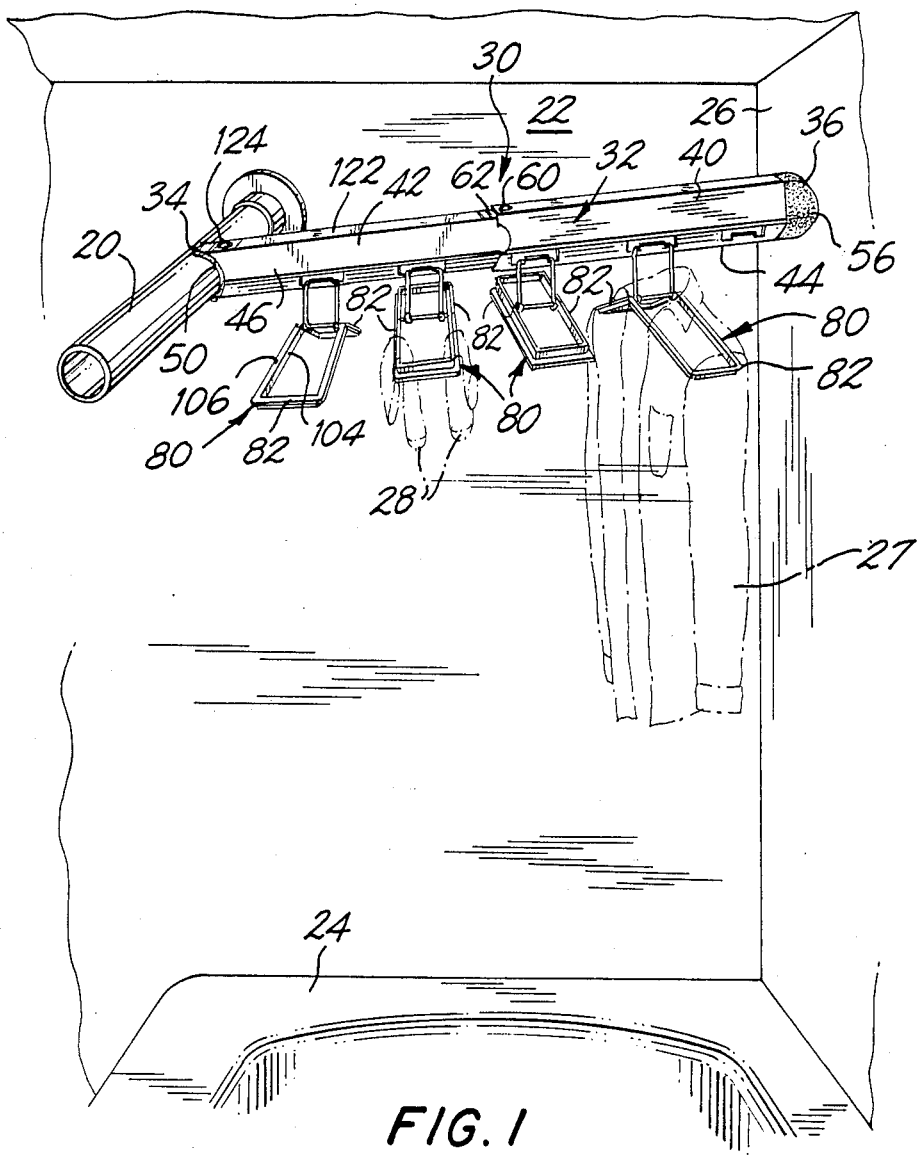
FIG. 1 is a pictorial view of an apparatus constructed in accordance with the invention, showing component parts in the form of a hanger bar erected and installed for use in connection with a plurality of hangers to establish a complete dryer.

Referring now to the drawing, and especially to FIG. 1 thereof, travelers wishing to wash or rinse-out various articles of clothing, such as shirts and blouses, socks and stockings, undergarments and the like, usually have available to them, as a part of their hotel or motel accommodations, a shower which includes a shower curtain rail 20 affixed to a wall 22 above a tub 24 and extending parallel to an opposite shower wall 26. An apparatus constructed in accordance with the present invention is shown in the form of dryer 30 and is seen to make use of the existing available structural members in the form of shower curtain rail 20 and opposite shower wall 26 for the purpose of supporting the dryer 30 in place for the reception of the articles to be dried, such as a shirt 27 and socks 28, shown in phantom in FIG. 1.

Figure 2:
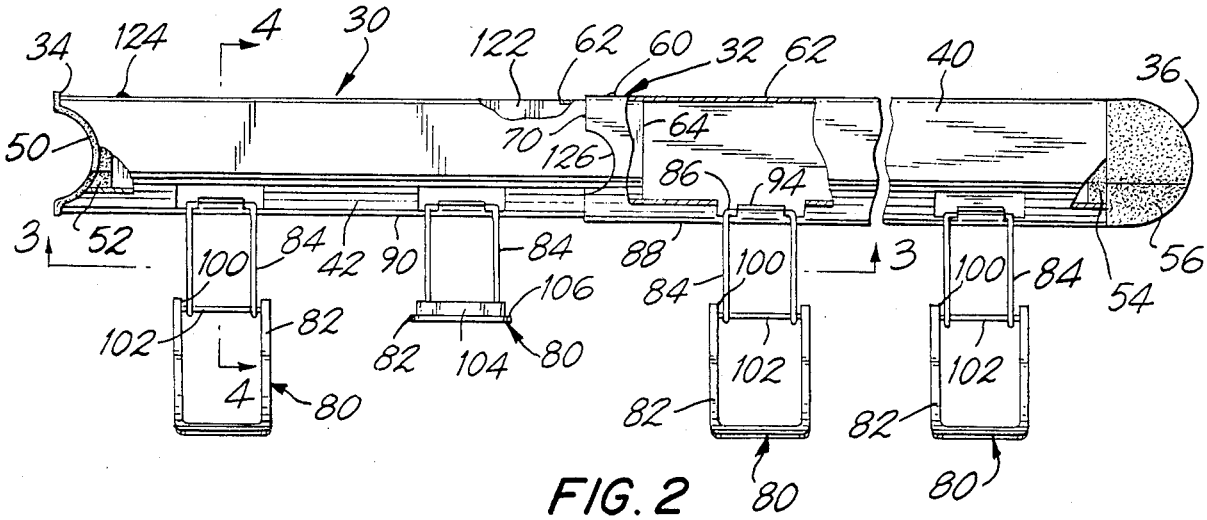
FIG. 2 is a front elevational view, partially sectioned, of the erected dryer.
Figure 11:
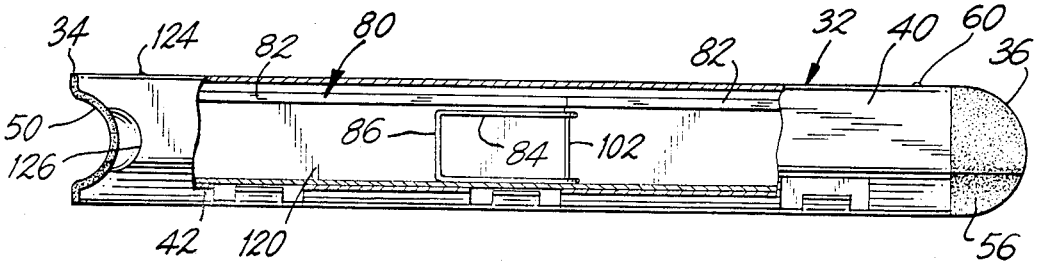
FIG. 11 is a front elevational view, partially sectioned, of the dryer in collapsed configuration for carrying and storage.

As best seen in FIG. 2, as well as in FIG. 1, dryer 30 includes a hanger bar 32 extending between opposite ends 34 and 36 and is constructed in the form of telescopically engaged first and second segments, including a casing segment 40 and a core segment 42. Both the casing segment 40 and the core segment 42 have a sleeve-like construction, including a generally tubular wall 44 and 46, respectively, the wall 46 of the core segment 42 fitting within the wall 44 of the casing segment 40 for sliding telescopic movement of the core segment 42 relative to the casing segment 40 between an extended position, wherein the segments 40 and 42 are generally tandem, as seen in FIGS. 1 and 2, and a collapsed position, wherein the core segment 42 is substantially entirely telescoped within the casing segment 40, as seen in FIG. 11.

When the core segment 42 is in the extended position and hanger bar 32 is in the extended configuration illustrated in FIGS. 1 and 2, hanger bar 32 has a longitudinal length, between opposite ends 34 and 36, which exceeds, at least slightly, the given lateral distance between the shower curtain rail 20 and the opposite shower wall 26 so that the hanger bar 32 will be supported between the shower curtain rail 20 and the opposite shower wall 26 by merely abutting the one end 34 with the shower curtain rail 20 and then leaning the other end 36 against the opposite shower wall 26, as illustrated in FIG. 1. To that end, the one end 34 of the hanger bar 32 is provided with an arcuate recess 50 complementary to the outer configuration of the shower curtain rail 20 and the recess 50 is lined with a resilient material, such as an elastomer, provided in the form of a plug 52 of elastomeric material seated within the end 34 of the hanger bar 32, in the core segment 42. Another plug 54 of elastomeric material is seated within the casing segment 40 at the other end 36 of the hanger bar 32 and provides a resilient nose 56. The resilient recess 50 and the resilient nose 56 enable the hanger bar to grip the structural members between which the hanger bar 32 is supported for stable support, while at the same time protecting the shower curtain rail 20 and the opposite shower wall 26 against marring.

Figure 5:
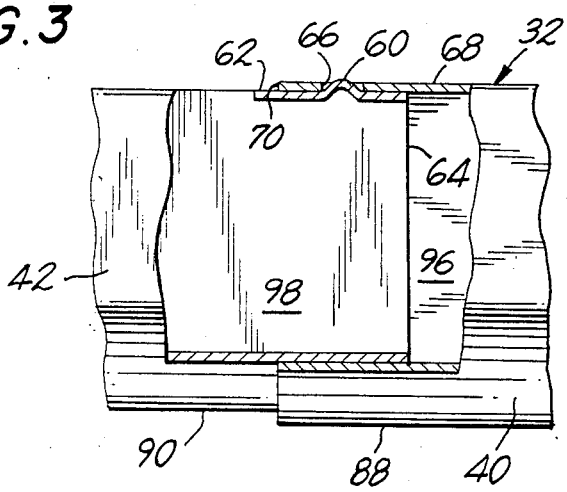
FIG. 5 is an enlarged fragmentary view, partially sectioned, of a portion of the dryer.

The core segment 42 is secured in the extended position relative to the casing segment 40 by securing means shown in the form of detent elements placed in each of the segments. Thus, as best seen in FIG. 5, a raised button 60 is placed in the upper wall portion 62 of core segment 42, adjacent the end 64 of the core segment 42, and a complementary aperture 66 is placed in the corresponding upper wall portion 68 of the casing segment 40, adjacent the end 70 of the casing segment 40, so that upon extension of the hanger bar 32 to the full length thereof the button 60 will snap into the aperture 66 and secure the segments 40 and 42 against movement relative to one another.

Figure 3:
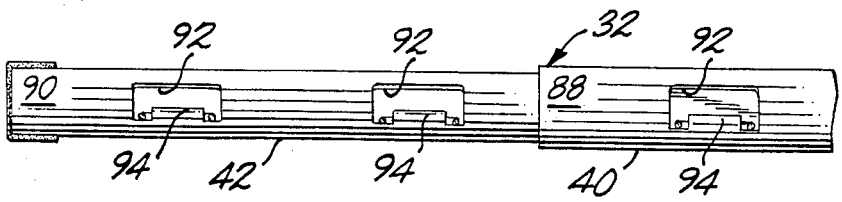
FIG. 3 is a fragmentary bottom plan view of the erected dryer, showing the hanger bar thereof viewed along line 3—3 of FIG. 2.
Figure 4:
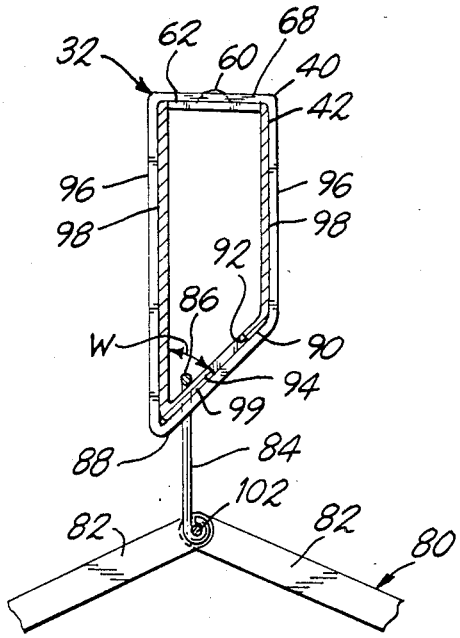
FIG. 4 is an enlarged cross-sectional view taken along line 4—4 of FIG. 2.

When the hanger bar 32 is in the extended configuration and is supported between the shower curtain rail 20 and the opposite shower wall 26, a plurality of hanger 80 may be suspended from the hanger bar 32 for hanging the articles of clothing to be dried. Each hanger 80 includes hanger members 82 which extend in a generally lateral direction and a bail 84 attached to the hanger members 82. In the erected configuration of the hanger 80, the bail 84 projects altitudinally upwardly relative to the hanger members 82 and carries connector means in the form of a looped upper end 86 for connecting the bail to the hanger bar 32 and suspending the hanger 80 from the hanger bar 32. The casing segment 40 and the core segment 42 of the hanger bar 32 include lower wall portions 88 and 90, respectively, and the lower wall portions 88 and 90 carry suspension elements in the form of slots 92 each having a tongue 94 projecting into the slot 92, as seen in FIG. 3. In order to suspend a hanger 80 from the hanger bar 32, the looped upper end 86 of the bail 84 of the hanger 80 is slipped into a slot 92 and over a tongue 94, as shown in FIG. 4. In this manner, any number of hangers 80 may be suspended from the hanger bar 32, up to the number of slots 92 provided in the hanger bar 32. It is noted that the tongues 94 project laterally into the slots 92 and remain flush with the respective lower wall portions 88 and 90 so that the tongues 94 do not protrude outside the envelope defined by the wall 46 of core segment 42 and will not interfere with the telescoping of the core segment 42 into the casing segment 40. Nor will the tongues 94 project outside the envelope defined by the wall 44 of the casing segment 40, so that the tongues 94 will not snag on surrounding items, as will be explained in further detail below. The hanger bar 32 is provided with a trapezoidal cross-sectional configuration, with the longer side wall portions 96 and 98 of the casing segment 40 and the core segment 42, respectively, oriented altitudinally and spaced apart laterally when the hanger bar 32 is in place for the hanging of articles of clothing, so that the load of the wet articles of clothing is sustained by the box-like cross-sectional configuration. The lower wall portions 88 and 90 are slanted with respect to the side wall portions 96 and 98, each lower wall portion 88 and 90 making an acute angle W with one of the respective side wall portions 96 and 98, so that the tongues 94 are angled upwardly for enhancing the capture of upper looped end 86 of a respective bail 84 as the upper looped end 86 is passed over tongue 94, and to establish a hook-like purchase 99 for better securement of hangers 80 against falling from hanger bar 32, while still maintaining the flush relationship between each tongue 94 and a respective slot 92.

Each hanger 80 includes two hanger members 82, each having a generally elongate U-shaped configuration, the hanger members 82 being joined together at the confronting open ends 100 of the two U-shaped hanger members 82 by means of a pin 102. The hanger members 82 have an L-shaped cross-sectional configuration and include a web 104 and a flange 106. Limited pivotal movement of one hanger member 82 relative to the other hanger member 82 of a hanger 80 is permitted by the connection at pin 102, as will be described in greater detail below. The bail 84 is pivotally mounted on the pin 102 and lies inside the U-shaped configuration so that the bail 84 is free to rotate about the pin 102 throughout a full 360° of rotation. Thus, as seen in FIG. 6, a hanger 80 is in a collapsed configuration with the hanger members 82 extending laterally outwardly, at a straight angle A relative to one another, and the bail 84 in a collapsed position wherein the bail 84 extends laterally coextensive with one of the hanger members 82.

Figure 7:
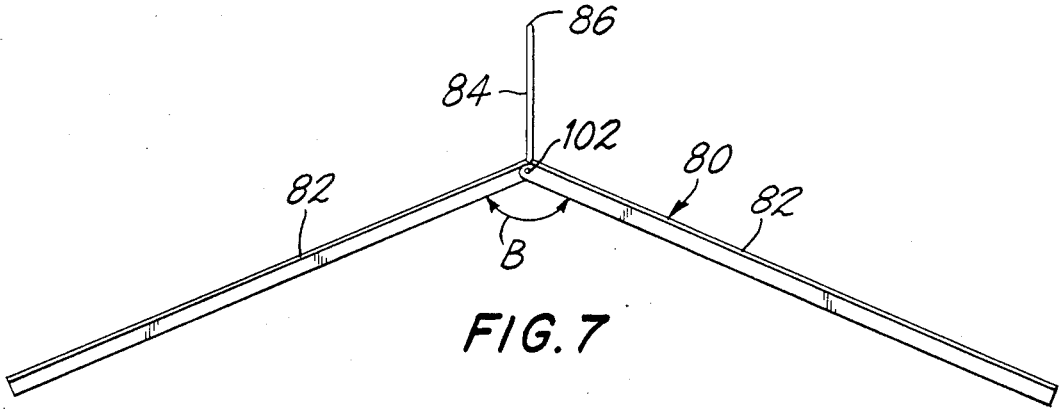
FIG. 7 is a front elevational view of the hanger erected for use in connection with the drying of particular articles of clothing, such as shirts and blouses.
Figure 8:
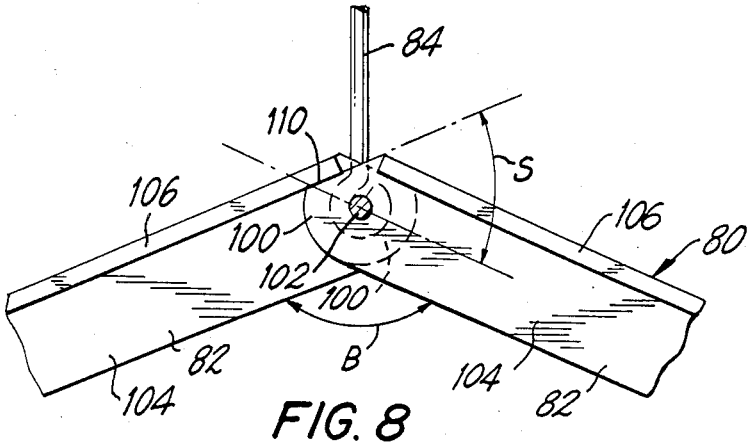
FIG. 8 is an enlarged fragmentary cross-sectional view of a portion of FIG, 7.

When it is desired to utilize a hanger 80 for hanging out to dry an article of clothing such as a shirt or blouse which requires that the hanger 80 be erected with the hanger members 82 at an obtuse angle, such as illustrated in FIG. 7 wherein the hanger members 82 are at obtuse angle B relative to one another, the hanger 80 is oriented with the flanges 106 of the hanger members 82 placed uppermost, and the bail 84 is extended to project altitudinally upwardly relative to the hanger members 82. The hanger members 82 will pivot about pin 102 until a shoulder 110 on the web 104 at the end 100 of one of the hanger members 82 comes into abutment with the flange 106 at the end 100 of the other hanger member 82, as shown in FIG. 8. The angles of the shoulder 110 then determines the proper obtuse angle B between the hanger members 82.

Figure 9:
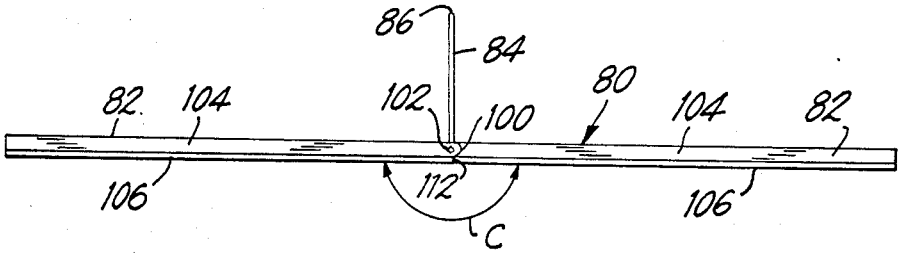
FIG. 9 is a front elevational view of a hanger erected for use in connection with the drying of other articles of clothing, such as socks and stockings.
Figure 10:
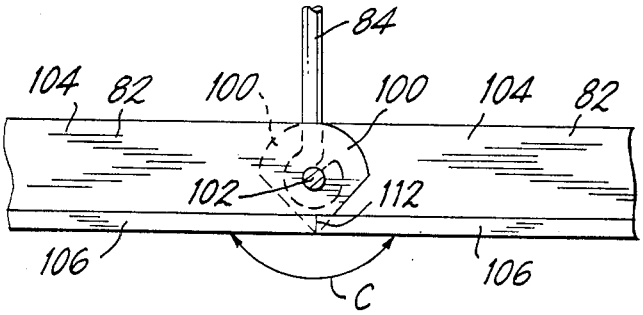
FIG. 10 is an enlarged fragmentary cross-sectional view of a portion of FIG. 9.

When it is desired to hang out to dry articles of clothing which are better draped over a generally horizontal structure, such as socks, stockings and the like, a hanger 80 may be erected into a configuration in which the hanger members 82 extend at a straight angle relative to one another. Thus, as seen in FIGS. 9 and 10, a hanger 80 is oriented with the flanges 106 of the hanger members 82 placed lowermost and the bail 84 is swung upwardly to project in an altitudinal direction opposite the altitudinal direction illustrated in FIGS. 7 and 8. The flanges 106 of the hanger members 82 then abut one another at the ends 100, as seen at 112, and the hanger members 82 are maintained at a straight angle C relative to one another. Hence, by merely reversing the orientation of the hanger 80, the hanger may be erected in alternate configurations for accommodating essentially any article of clothing requiring drying. It is noted that the flush relationship of the tongues 94 within slots 92 resists snagging of the articles of clothing on the tongues 94.

Figure 6:
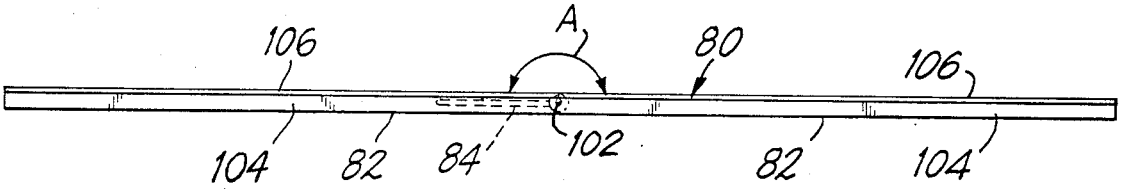
FIG. 6 is a front elevational view of a hanger used in connection with the hanger bar of the dryer, the hanger being collapsed for storage.

When the dryer 30 is to be transported or stored, the hangers 80 are collapsed into the configuration illustrated in FIG. 6 and are placed inside the core segment 42 of the hanger bar 30, and the core segment 42 then is telescoped fully into the casing segment 40, as seen in FIG. 11. Both the casing segment 40 and the core segment 42 have a generally trapezoidal cross-sectional configuration and are hollow so as to provide a chamber 120 in the core segment 42 for the reception of the collapsed hangers 80 and for the reception of the core segment 42 within the casing segment 40 in the collapsed configuration of the hanger bar 30. An opening 122 in the upper wall portion 62 of the core segment 42 (also see FIG. 1) provides access to the chamber 120 for selective placement of the hangers 80 into the chamber 120 and for selective removal of the hangers 80 from the chamber 120. Upon fully telescoping the core segment 42 into the casing segment 40, a second button 124 of the securing means, located in the upper wall portion 62 of core segment 42, will snap into aperture 66 in the upper wall portion 68 of casing segment 40 to secure the core segment 42 within the casing segment 40. A finger recess 126 is provided at the open end 70 of the casing segment 40 for facilitating the grasping of the core segment 42 when the core segment 42 is to be pulled from within the casing segment 40 for extension of the hanger bar 32.

In the collapsed configuration of the hanger bar 32, dryer 30 is exceptionally compact and contains all of the structural items necessary for drying the various articles of clothing ordinarily washed or rinsed by a traveler. The dryer 30 is unobtrusive and is carried readily for use at any location where the traveler finds accommodations. When packed among other items, including articles of clothing, the flush relationship of the tongues 94 within slots 92 resists snagging or other damage to the surrounding items. The construction is very lightweight, yet rugged enough to withstand both the loads of use and the stresses of transportation.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A self-contained, portable dryer for use in drying articles of clothing by supporting the dryer between existing opposed structural members spaced apart by a given lateral distance, such as a shower curtain rail and an opposite shower wall, and hanging the articles of clothing from the dryer, the dryer comprising:

a hanger bar having opposite ends and extending longitudinally between opposite ends and including a first segment and a second segment, the first segment having a sleeve-like configuration for receiving the second segment in telescoping engagement therewith, and each segment including a wall extending along the length of the respective segment;

selective securement means on the hanger bar for selectively securing the first and second segments against relative telescoping movement when the first and second segments are at either one of a collapsed position, wherein the second segment is substantially entirely telescoped within the first segment for compact carrying, and an extended position, wherein the second segment is essentially tandem with the first segment and the length of the hanger bar between the ends thereof exceeds at least slightly the lateral distance between the opposed existing structural members for supporting the hanger bar between the structural members;

a plurality of suspension elements integral with the wall of at least one of the first and second segments, the suspension elements being spaced longitudinally from one another along the length of the one segment;

a plurality of hangers, each hanger having laterally-extending hanger members and a bail associated with the hanger members;

collapsing means coupling each bail with corresponding hanger members such that the bail is selectively movable between a first position wherein the bail is extended to project altitudinally relative to the laterally-extending hanger members, and a second position wherein the bail is collapsed to extend laterally in coextensive relationship with the hanger members;

each bail including connector means for selective engagement with and disengagement from a suspension element when the bail is in the extended position for selectively suspending and releasing the corresponding hanger from the hanger bar, with each bail oriented altitudinally and the hanger members oriented laterally for the reception of the articles to be hung for drying; and a chamber within the hanger bar for reception of the hangers, when the respective bails are in the collapsed position, for storage of the hangers when not in use.

2. The invention of claim 1 wherein the suspension elements include slots within the wall of at least one of the segments.

3. The invention of claim 2 wherein the suspension elements include a tongue within the slot and the connector means of each bail includes a looped portion engageable with a respective tongue for suspending the bail from the tongue.

4. The invention of claim 3 wherein each tongue essentially is flush with the respective wall of the segment.

5. The invention of claim 4 wherein the slots and tongues are placed along both the first and second segments, the flush positions of the tongues enabling telescoping of the first and second segments into the collapsed position thereof.

6. The invention of claim 1 wherein the selective securement means include detent elements on the first and second segments for selective engagement to secure the first and second segments in either one of the collapsed position, for carrying and storage, and the extended position, for use in drying the articles of clothing.

7. The invention of claim 1 wherein the segments have a generally trapezoidal cross-sectional configuration, the wall of each segment including altitudinally oriented side wall portions and a lower wall portion slanted relative to the side wall portions so as to make an acute angle with one of the side wall portions.

8. The invention of claim 7 wherein the suspension elements include slots within the lower wall portion of at least one of the segments.

9. The invention of claim 8 wherein the suspension elements include a tongue within each slot and the connector means of each bail includes a looped portion engageable with a respective tongue for suspending the bail from the tongue.

10. The invention of claim 9 wherein each tongue essentially is flush with the lower wall portion of the segment and is angled altitudinally upwardly to establish a hook-like purchase for the bail of a respective hanger.

11. The invention of claim 10 wherein the slots and tongues are placed along both the first and second segments, the flush positions of the tongues enabling telescoping of the first and second segments into the collapsed position thereof.

12. The invention of claim 1 wherein the collapsing means includes means enabling selective movement of the bail to a third position wherein the bail extends altitudinally in a direction opposite to the direction in which the bail extends when in the first position, the hanger members including tandem sections having adjacent ends, pivot means joining the tandem sections at the adjacent ends, and positioning means at the adjacent ends, the positioning means positioning the sections at an obtuse angle relative to one another when the hanger is suspended with the bail in the first position thereof, and for positioning the sections at an essentially straight angle when the hanger is suspended with the bail in the third position thereof.

13. A hanger for use in connection with a self-contained, portable dryer to be used in drying articles of clothing by supporting the dryer between existing opposed structural members spaced apart by a given lateral distance, such as a shower curtain rail and an opposite shower wall, and hanging the articles of clothing from the dryer, the dryer including a hanger bar extending between opposite ends and a plurality of suspension elements integral with the hanger bar, the hanger comprising:

laterally-extending hanger members and a bail associated with the hanger members; and collapsing means coupling each bail with corresponding hanger members such that the bail is selectively movable between a first position wherein the bail is extended to project altitudinally relative to the laterally-extending hanger members, and a second position wherein the bail is collapsed to extend laterally in coextensive relationship with the hanger members;

each bail including connector means for selective engagement with a suspension element when the bail is in the extended position for suspending the corresponding hanger from the hanger bar, with each bail oriented altitudinally and the hanger members oriented laterally for the reception of the articles to be hung for drying;

the collapsing means including means enabling selective movement of the bail to a third position wherein the bail extends altitudinally in a direction opposite to the direction in which the bail extends when in the first position, the hanger members including tandem sections having adjacent ends, pivot means joining the tandem sections at the adjacent ends, and positioning means at the adjacent ends, the positioning means positioning the sections at an obtuse angle relative to one another when the hanger is suspended with the bail in the first position thereof, and for positioning the sections at an essentially straight angle when the hanger is suspended with the bail in the third position thereof.

* * * * *